US008915408B1

(12) United States Patent
Hill

(10) Patent No.: US 8,915,408 B1
(45) Date of Patent: Dec. 23, 2014

(54) BABY BOTTLE SUPPORT SYSTEM FOR FEEDING A BABY

(71) Applicant: Martin Richard Hill, Wellington, FL (US)

(72) Inventor: Martin Richard Hill, Wellington, FL (US)

( * ) Notice: Subject to any disclaimer, the term of this patent is extended or adjusted under 35 U.S.C. 154(b) by 12 days.

(21) Appl. No.: 13/740,375

(22) Filed: Jan. 14, 2013

Related U.S. Application Data

(60) Provisional application No. 61/585,731, filed on Jan. 12, 2012.

(51) Int. Cl.

| | |
|---|---|
| ***A45F 3/16*** | (2006.01) |
| ***A45F 5/00*** | (2006.01) |
| ***A45F 3/12*** | (2006.01) |
| ***A47D 15/00*** | (2006.01) |
| ***A61J 9/06*** | (2006.01) |

(52) U.S. Cl.
CPC ..... *A61J 9/06* (2013.01)
USPC ..... 224/148.4; 224/148.5; 224/148.6; 224/264; 248/102

(58) Field of Classification Search
CPC ..... A45F 5/00; A45F 3/16; A45F 3/18; A45F 3/20; A45F 2200/20
USPC ..... 224/148.4, 148.5, 148.6, 264, 642; 248/102
See application file for complete search history.

(56) References Cited

U.S. PATENT DOCUMENTS

| | | | | | |
|---|---|---|---|---|---|
| 546,033 | A * | 9/1895 | Shepard | 248/102 |
| 2,494,632 | A * | 1/1950 | Rodin | 248/102 |
| 2,617,105 | A * | 11/1952 | Backman | 2/48 |
| 2,808,973 | A * | 10/1957 | Gobble | 224/264 |
| 2,880,950 | A * | 4/1959 | Williams et al. | 248/102 |
| 2,893,672 | A * | 7/1959 | Vardan | 248/102 |
| 2,907,539 | A * | 10/1959 | Vardan | 248/104 |
| 2,938,693 | A * | 5/1960 | Vardan | 248/104 |
| 3,065,944 | A * | 11/1962 | Liebendorfer | 248/102 |
| 3,144,230 | A * | 8/1964 | Brooks | 248/102 |
| 3,197,099 | A * | 7/1965 | Doba | 224/148.4 |
| 3,365,153 | A * | 1/1968 | Baucom | 248/102 |
| 3,850,393 | A * | 11/1974 | Marquard | 248/102 |
| 3,977,638 | A * | 8/1976 | Woodard | 248/102 |
| 4,220,302 | A * | 9/1980 | Hampton et al. | 248/102 |
| 4,498,613 | A * | 2/1985 | Donahue et al. | 224/251 |
| 4,537,341 | A * | 8/1985 | Kelly | 224/620 |
| 4,564,957 | A * | 1/1986 | Scharf | 2/75 |
| 5,390,838 | A * | 2/1995 | Jafarkhani | 224/148.4 |
| 5,573,153 | A * | 11/1996 | Stillman | 224/148.6 |
| 5,820,084 | A * | 10/1998 | Trumbauer et al. | 248/102 |
| 5,873,551 | A * | 2/1999 | Jones | 248/102 |
| 6,000,664 | A * | 12/1999 | Hood | 248/102 |
| 6,398,088 | B1 * | 6/2002 | Burke | 224/160 |
| 6,986,487 | B2 * | 1/2006 | Rich | 248/104 |
| 7,004,363 | B2 * | 2/2006 | Fenton et al. | 224/264 |
| 7,048,160 | B2 * | 5/2006 | Anderson | 224/148.6 |
| 7,316,035 | B2 * | 1/2008 | Archambault | 2/46 |

(Continued)

*Primary Examiner* — Justin Larson
*Assistant Examiner* — Lester L Vanterpool
(74) *Attorney, Agent, or Firm* — Malin Haley DiMaggio & Bowen, P.A.

(57) ABSTRACT

A device to assist in the feeding of an infant from a bottle comprising a shoulder support pad shaped like a figure eight comprised of a washable material including a nonskid on the underside having ridges and valleys. A baby bottle holder is rotatably attached near one end of said shoulder support band. The caregiver can hold and support an infant in one arm and hand greatly reducing the effort required to feed an infant milk from a baby bottle.

8 Claims, 12 Drawing Sheets

(56) References Cited

U.S. PATENT DOCUMENTS 8,499,987 B2 * 8/2013 Fidrych et al. ..... 224/264
2006/0000858 A1 * 1/2006 Jung ..... 224/264
2006/0102810 A1 * 5/2006 Banks ..... 248/102

* cited by examiner

BABY BOTTLE SUPPORT SYSTEM FOR FEEDING A BABY

CROSS REFERENCE TO RELATED APPLICATIONS

This application claims the benefit of priority to U.S. Provisional Patent Application Ser. No. 61/585,731, filed on Jan. 12, 2012.

BACKGROUND OF THE INVENTION

1. Field of the Invention

This invention relates generally to a device for supporting a baby bottle during infant feeding, and specifically to a baby bottle support system that includes a support pad and a movable bottle holder that allows the caregiver to comfortably feed a baby using only one hand.

2. Description of Related Art

Feeding an infant or very young baby using a baby bottle can be a physically demanding task. First an infant must be fed several times day and night often resulting in sleep deprivation of the caregiver. Most infants must be physically held in the arm or arms of the caregiver during the feeding process. The caregiver must also position and hold the baby bottle containing the baby's milk. The total time required for feeding one infant adds up to a significant amount of time per month.

The invention described herein greatly reduces the physical effort required to feed an infant baby. As the instant invention allows such feeding to be accomplished using one hand, it allows a caregiver to multitask while feeding. Also the invention does not require straps, clips or buckles for use.

Another big advantage of the invention is that the bottle can be left in the holder in an upright or tilted position while burping or playing with the infant. Infants need to be burped often during a feeding, and finding a place to rest the bottle can sometimes be a challenge. With the present device, the bottle holder can easily be rotated so that the bottle is in an upright position and either remains positioned over the shoulder, or the device can be located in a convenient location until needed. The bottle is secure while in the holding device and will not fall out. Due to the shoulder pad's design and material, the bottle holder conforms to whatever it is placed upon and grips due to the ridges on the pad's underside.

SUMMARY OF THE INVENTION

A baby bottle support system for use in feeding an infant comprising a non-slip shoulder support pad that has a shoulder-engaging flexible support strip of material. A baby bottle holder is rotatably attached to said shoulder support pad.

The baby bottle holder includes a flexible foam shell body with a concave cavity sized to receive snuggly a large portion of the baby bottle exterior surface to hold the bottle firmly in place once the bottle is manually inserted into the holder body foam cavity. The bottle holder cavity foam walls are sufficiently resilient (moveable) to allow manual insertion and removal of the baby bottle into and out of the holder body cavity. The diameter of the holder body cavity is substantially equal to the diameter of a conventional baby bottle, but is flexible enough to receive and hold baby bottles of different diameters. The baby bottle holder body cavity is shaped cylindrically to conform to the exterior shape of the midsection of a baby bottle. The length of the cavity is less than the length of a conventional baby bottle such that the nipple bearing end of the bottle extends outwardly from the bottle holder for easy access to the infant for feeding.

The bottle holder is moveably attached (rotatable) to the shoulder support pad of material that fits over the shoulder of the caregiver. The cloth or sheet of material can have a non-skid surface on one side to help prevent the pad from moving when in place on the shoulder of the caregiver. The bottle holder can rotate relative to the support pad to adjust to the position of the infant during feeding including left or right handed feeding.

To use the device for feeding, the caregiver places the device over one shoulder and across the chest and positions the support pad and bottle holder in a comfortable location for feeding. A filled baby bottle is manually inserted into the foam holder body cavity. The bottle is moved to a feeding position relative to the infant. The infant is then held with one arm and hand to allow the infant to be fed with the nipple end of the bottle. Because the bottle holder can rotate in clockwise and counterclockwise directions, the invention can be used for left handed or right handed caregivers. The materials used in constructing the system such as the shoulder band and bottle holder are easily cleaned by wiping to remove spills.

It is an object of the invention to provide a baby bottle support system for feeding an infant with a baby bottle using one arm and hand to reduce the physical effort required to feed an infant.

It is another object of the invention to provide a baby bottle holder that is easy to manipulate and position for the comfort of the caregiver and the infant being fed. With the bottle holder being able to be rotated to an upright position, the bottle can be securely left in place over the shoulder while the caregiver burps or plays with the infant.

Other objects will be apparent to one of skill in the art.

PREFERRED EMBODIMENT OF THE INVENTION

Figure 1:
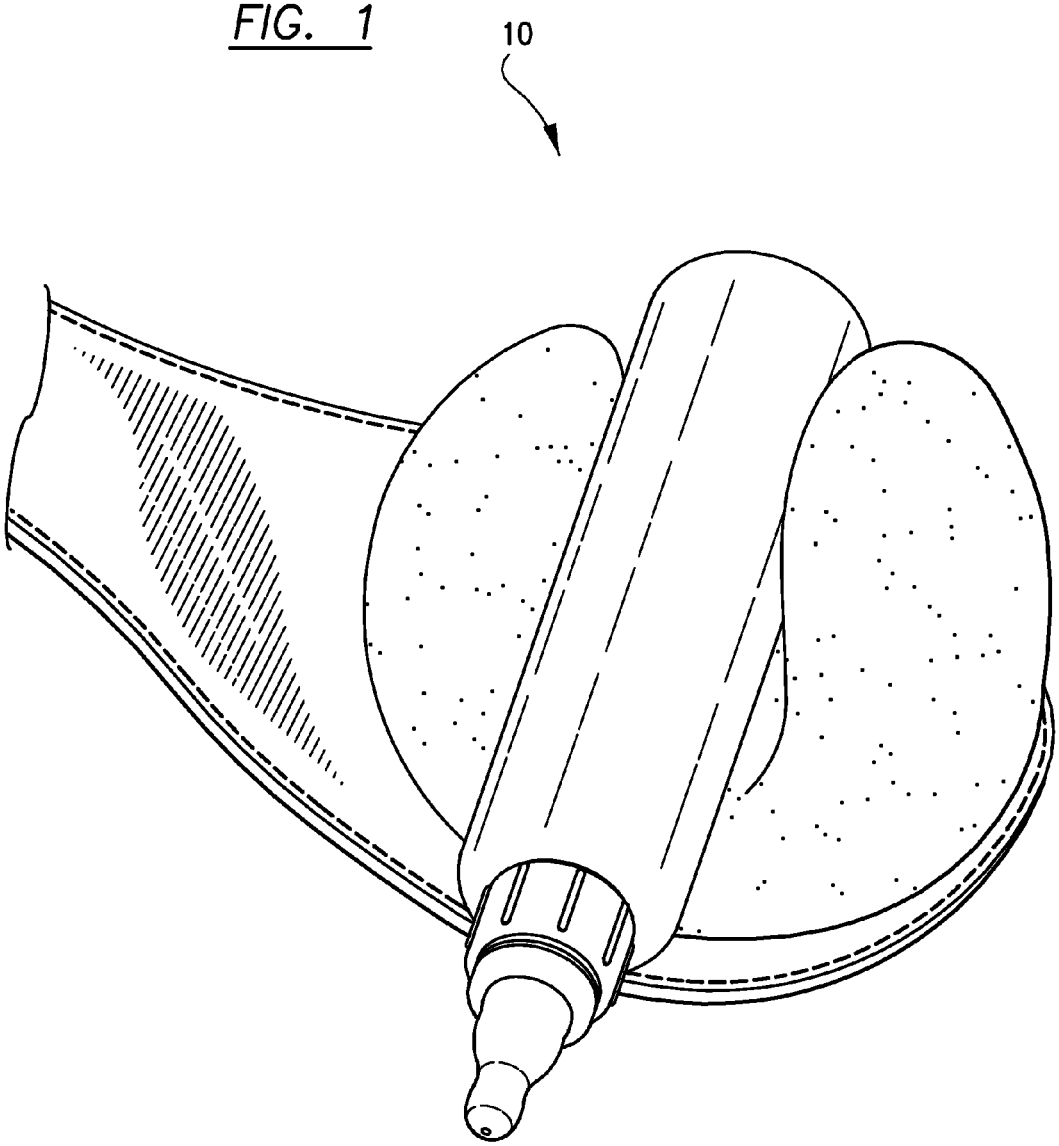
FIG. 1 shows a perspective view of the invention with a baby bottle attached.

Referring now to the drawings and in particular FIG. 1 the invention is shown comprising a pad or sheet of material that has a semi-circular first end with a bottle holder attached near the circular pad first end and non-skid material such as a rubber like sheet attached in the shoulder area. The material can be a natural or synthetic fiber woven or non woven. The bottle holder body is made of a resilient foam material such that the walls of the cavity holding the baby bottle can move to allow insertion and removal of the bottle while still holding the bottle firmly in place during feeding. The nipple end of the bottle projects away from the holder body so that an infant can be comfortably fed by postioning the support band and the bottle in the best location when the caregiver is holding the infant.

Figure 2:
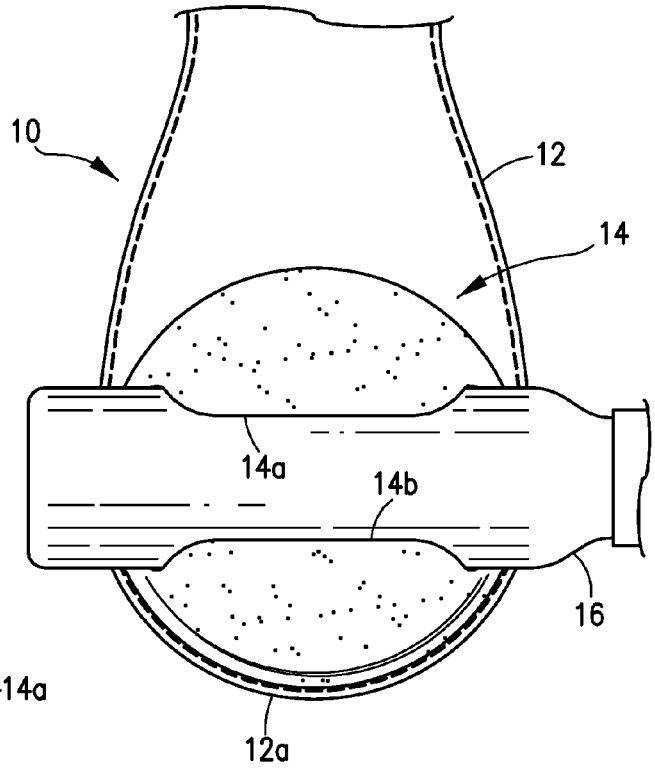
FIG. 2 shows a partial top plan view drawing of the invention.
Figure 3:
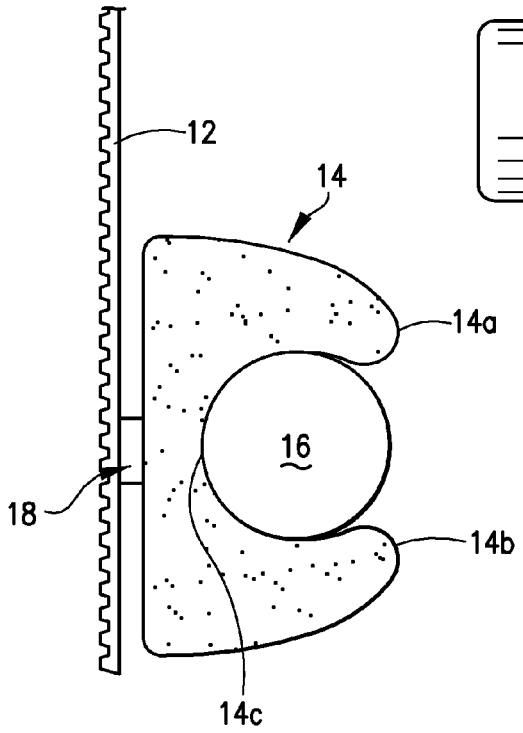
FIG. 3 shows a partial side elevational view drawing partially in cross section of the invention.

FIG. 2 and FIG. 3 show the invention 10 comprising a support pad or sheet of material 12 that is sized and shaped to drape over a caregiver's left or right shoulder comfortably and allow for the invention 10 to be held without requiring use of the caregiver's hands. The support pad 12 has a semi-circular end 12*a*. The baby bottle holder 14 is rotatably connected to support pad 12 allows for holding and positioning a baby bottle. A baby bottle 16 is firmly held in the foam holder 14 due to the cylindrical shape of holder body cavity 14*c* formed longitudinally in holder 14. Holder body arms 14*a* and 14*b* extent around the top and bottom of bottle 16 holding the bottle in place. The arms 14*a* and 14*b* can be moved apart because of the resilience of the foam material used for holder 14 which allows the caregiver to manually insert or remove the bottle 16 from the holder 14. Baby bottles of different diameters can be used because of the resilient material used for holder 14. FIG. 3 shows the rotating shaft 18 that is connected at one end to pad 12 and the other end rotatably to holder 14. The holder 14 can rotate 360 degrees in either direction so that a right handed or left handed person can use the feeding device.

Figure 4:
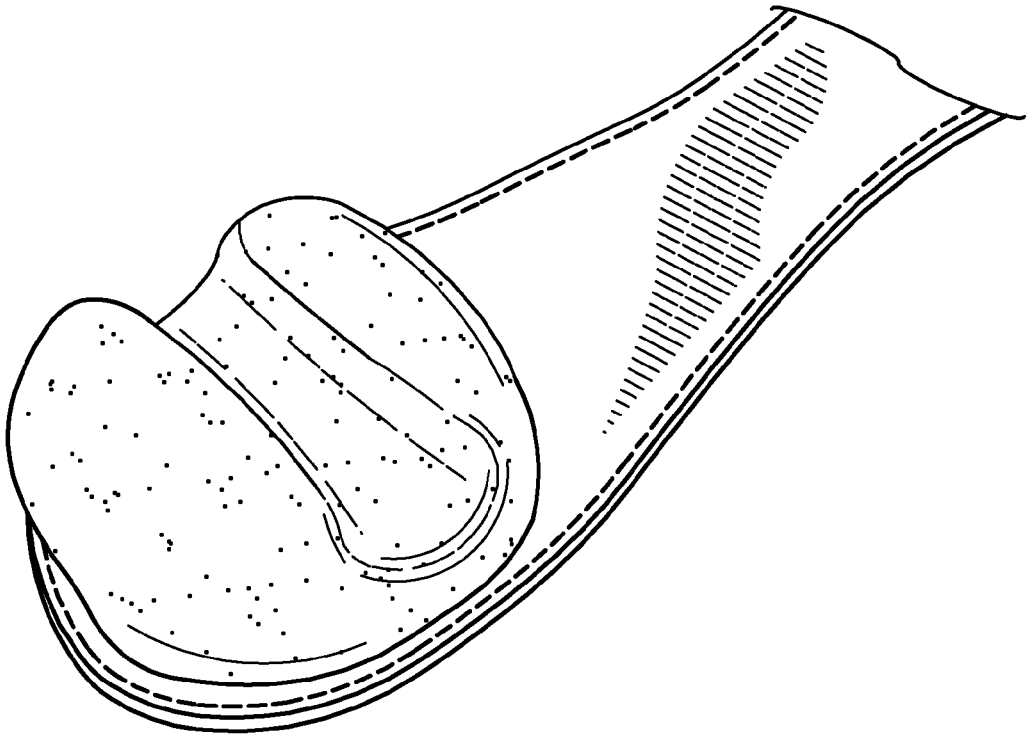
FIG. 4 shows a perspective view of the invention without a baby bottle.

FIG. 4 shows the invention without a baby bottle. The bottle holder body is empty showing a cylindrical cavity disposed longitudinally. The support pad extends away from the bottle holder. The support pad could have a non-skid material on the bottom side to grip the shoulder area to prevent movement of the pad and bottle holder during feeding. FIGS. 1-4 show the baby bottle holder 14 comprising a resilient smooth circular body having a movable flexible foam cylindrical cavity 14*a*, 14*b* and 14*c* extended across the body. The body cylindrical cavity is sized to receive a baby bottle.

Figure 5A:
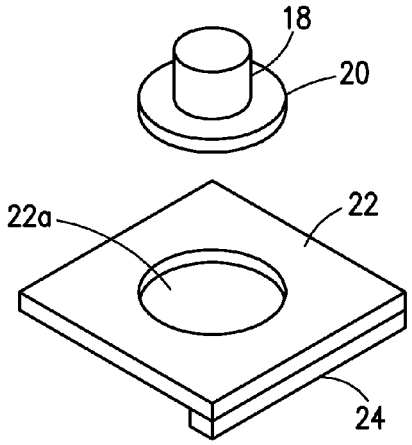
FIG. 5A shows an exploded view of an alternate embodiment of the rotatable base of the bottle holder.

Referring now to FIG. 5A, the bottle holder rotatable base is shown including a base plate 22 that has a circular socket 22*a* that receives the rigid disk 20 firmly attached to shaft 18. Disk 20 has a circular peripheral edge that could be curved so that it snaps into position in socket 22*a* while still permitting the disk 22 to rotate in socket 22*a*. The plate 22 is attached by adhesive 24 to the shoulder support band 12. The shaft 18 is rigidly affixed to bottle holder 14. A baby bottle can be rotated 360 degrees to a desired position for feeding.

Figure 5B:
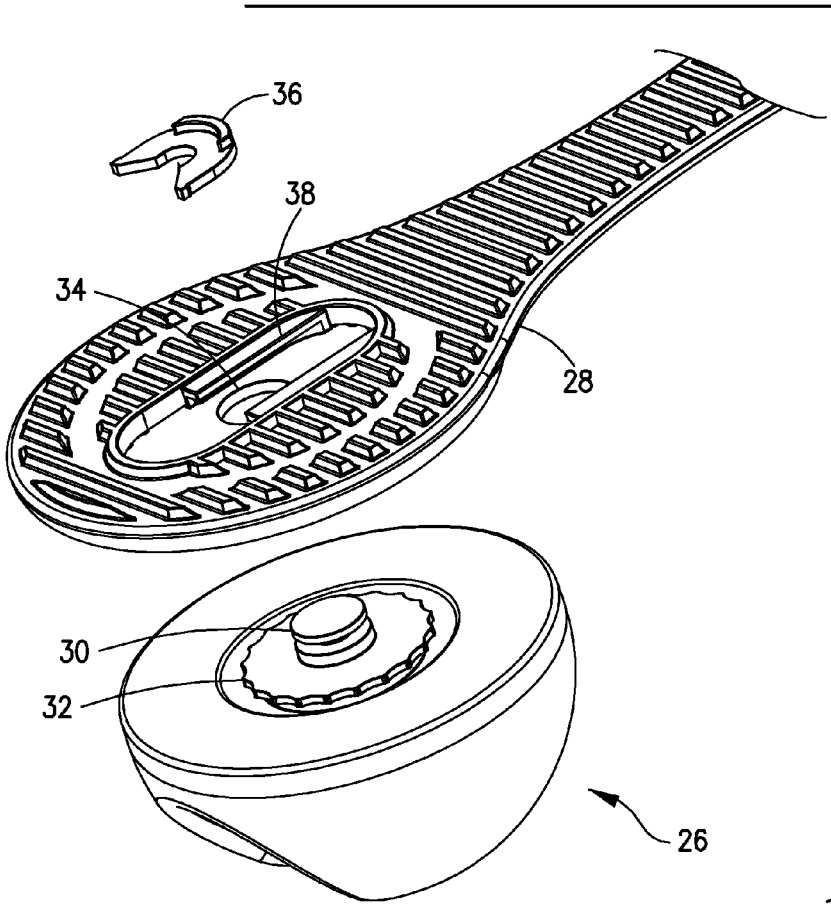
FIG. 5B shows an exploded view of the preferred embodiment of the attachment mechanism for the bottle holder base and support pad.

Referring now to FIG. 5B, the preferred embodiment utilizes an attachment mechanism for securely coupling the bottle holder 26 with the support pad 28 having three primary components: a bottle holder base 30, a support pad aperture 34 and base lock 36. To securely couple the bottle holder 26 on the support pad 28, the bottle holder base 30, which is structured as a shaft having a groove about its perimeter, is inserted into the support pad aperture 34 sufficient to pass through the support pad aperture 34 and consequently have a portion which is accessible from the opposite side of the support pad 28 from the bottle holder 26. The base lock 36 is then used to engage the portion of the bottle holder base 30 which is accessible from the opposite side of the support pad 28 to secure the bottle holder 26 to the support pad 28. To accomplish this, the base lock 36 must initially be slid with its raised middle ridge facing the sliding direction (and its open side facing away from the sliding direction) onto tracks 38 on the support pad 28. The tracks 38 on the support pad are two opposing rails under which the sides of the base lock 36 can slide. Once the base lock is slid past the support pad aperture 34, the bottle holder base 30 can be inserted through the support pad aperture 34 and the base lock 36 is slid in the opposite direction it initially was slid until its open side engages the bottle holder base 30. In the preferred embodiment, the base lock 36 engages the groove around the perimeter of the bottle holder base 36 to lock the bottle holder base 30 in place while still allowing rotational movement.

When the bottle holder base 30 is locked in place to the support pad 28 such that the bottle holder 26 is securely coupled to the support pad 28, the bottle holder 26 retains the ability to be rotated 360 degrees. In addition, the toothed disc 32 located underneath the bottle holder base 30 on the bottle holder 26 provides for setting the bottle holder 26 at its desired position for feeding or waiting. The toothed disc 32 allows for controlled movement where the bottle holder 26 can be manually spun in any direction but resists automatic movement beyond the space between the teeth of the toothed disc 32.

Figure 6:
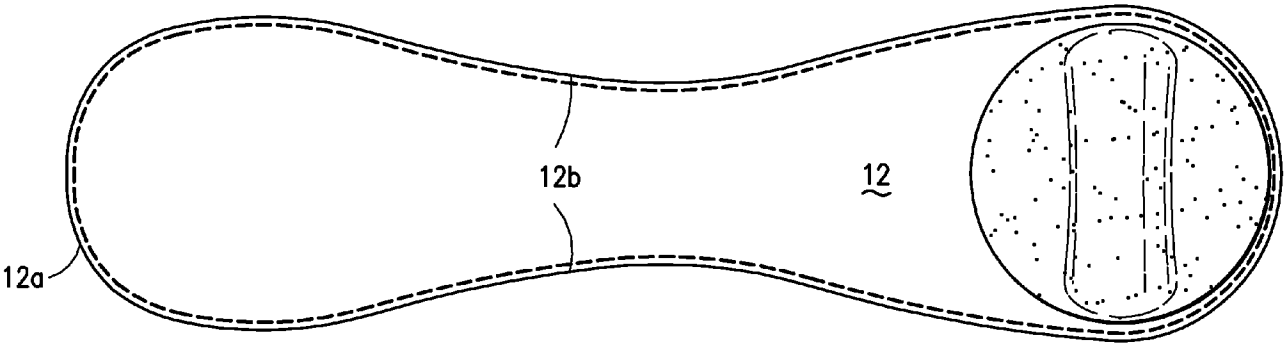
FIG. 6 shows a top plan view of the invention.

FIG. 6 shows a top plan view of the baby bottle holder that shows the overall figure eight shape of the support pad 12. Each end is round and the midsection is narrow compared with the round ends 12*a*. The narrowed portion of the support band 12 when in use contacts the shoulder area of the caregiver. Because the area 12*b* is narrow, the support band will not interfere with the neck of the caregiver. Also the support pad 12 can be used on the left shoulder or the right shoulder of the caregiver. The overall shape of the pad has been designed in a figure eight configuration for functional and ergonomic reasons. The pad is narrower in the center to allow minimal interference with the caregiver's neck. The larger end of the pad provides grip when placed over the caregiver's shoulders. The pad is symmetrical to allow for both left and right-handed caregivers.

Figure 7:
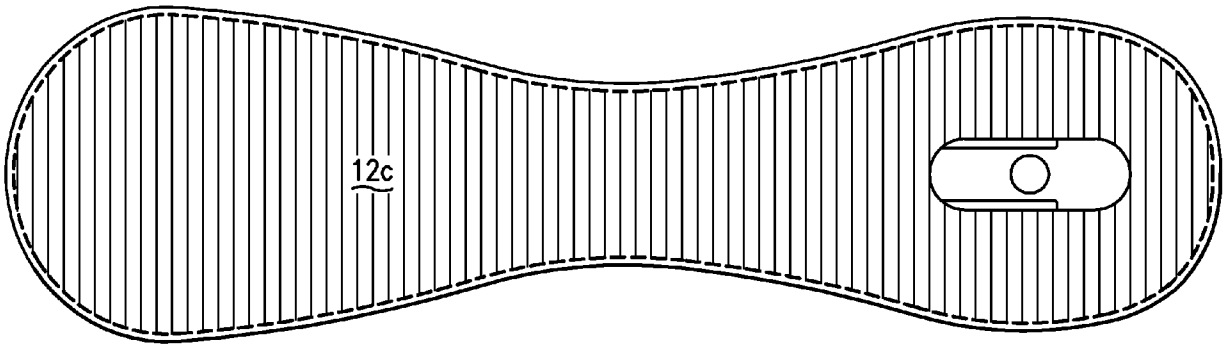
FIG. 7 shows a bottom plan view of the invention.

Referring now to FIG. 7, the bottom surface 12*c* of the support band is shown comprised of a plurality of parallel ridges separated by valleys. The ridges are perpendicular approximately to the longitudinal axis of the support band 12 the purpose of the ridges 12*c* is to ventilate the space between the support band as it contacts the caregiver when in use. When the support pad is placed over the shoulder of the caregiver, the pad conforms to the caregivers shoulder/body and the ridges on the back provide grip so that the pad cannot be moved easily and is comfortable.

Figure 8:
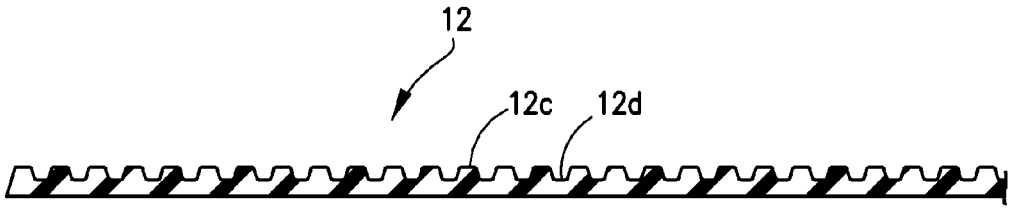
FIG. 8 shows a side elevational view of the bottom surface of the invention inverted.

Referring now to FIG. 8, the bottom surface of the pad is shown inverted to display a plurality of ridges 12*c* that are separated by valleys 12*d* to provide airflow when the device is used. The ridges and valleys prevent overheating during use, and also provide grip to prevent the pad from moving once in the desired position. To prevent discomfort for the caregiver during use, the ridges also allow air to flow between the caregiver's body and the pad. This prevents the pad or the caregiver from getting too warm while using the device.

Figure 9A:
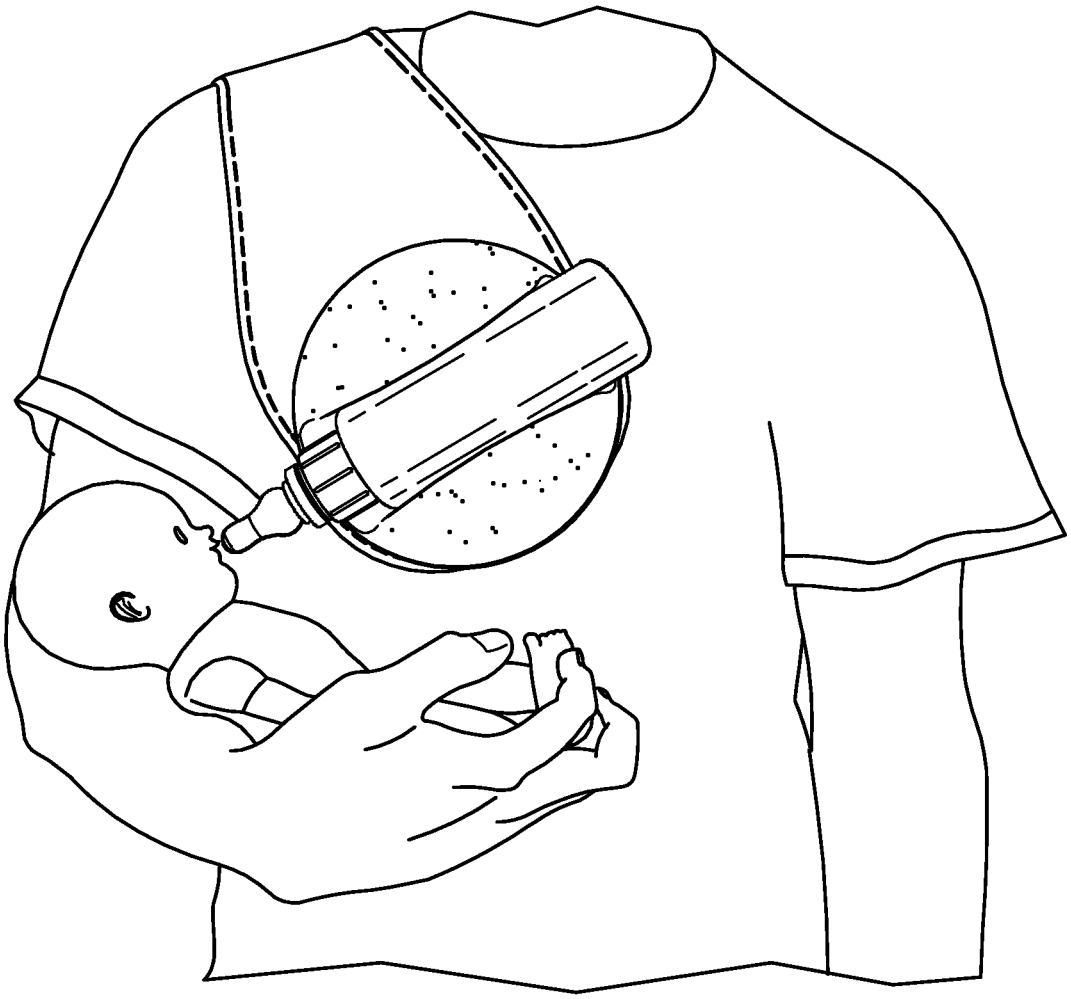
FIG. 9A shows a perspective view of the invention in which the caregiver is holding the baby in the right-hand.
Figure 9B:
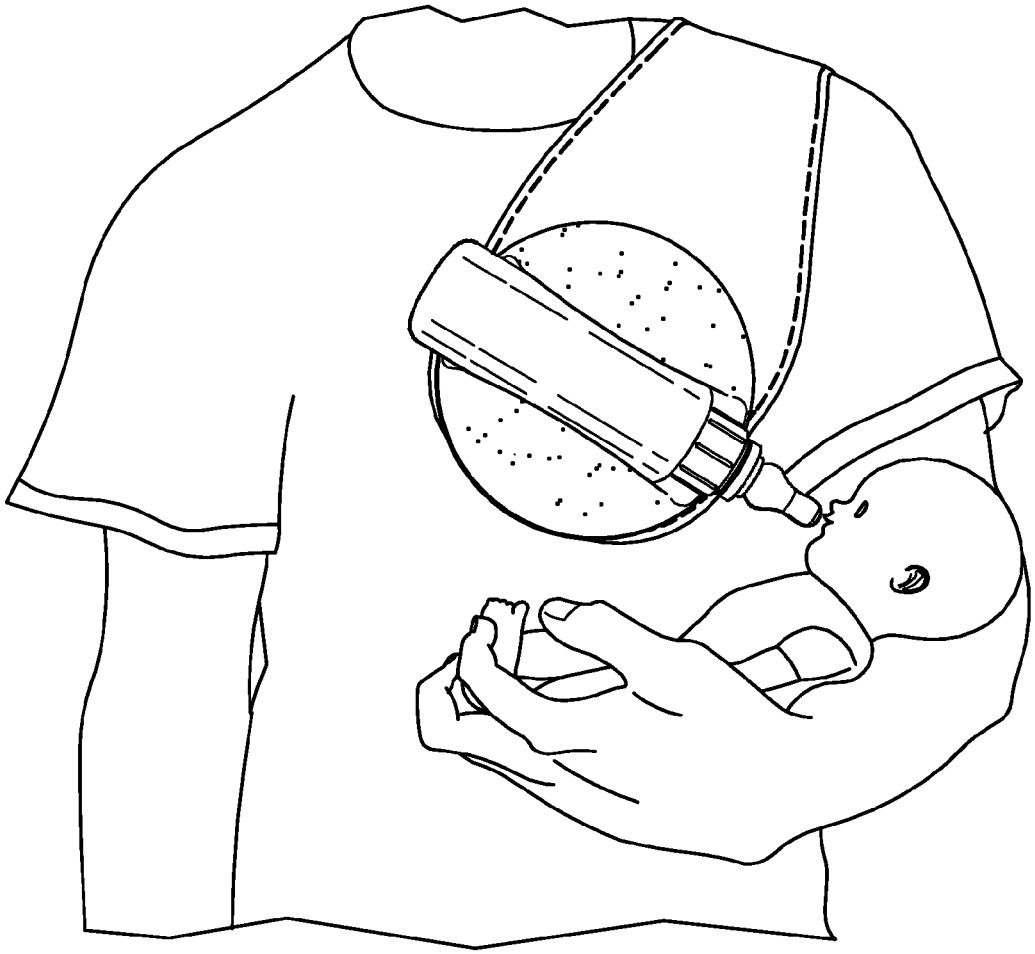
FIG. 9B shows a perspective view of the invention which the caregiver is holding the baby in the left-hand.

FIG. 9A shows a perspective view of the invention in which the caregiver is holding the baby in the right-hand. FIG. 9B shows a perspective view of the invention which the caregiver is holding the baby in the left-hand. Due to the symmetry of the support pad and the rotation of the bottle holder, a caregiver can use the device to feed a baby using either the left-hand or the right-hand. The narrowed portion of the support pad in the middle fits comfortably on either the left shoulder or the right shoulder.

Figure 10:
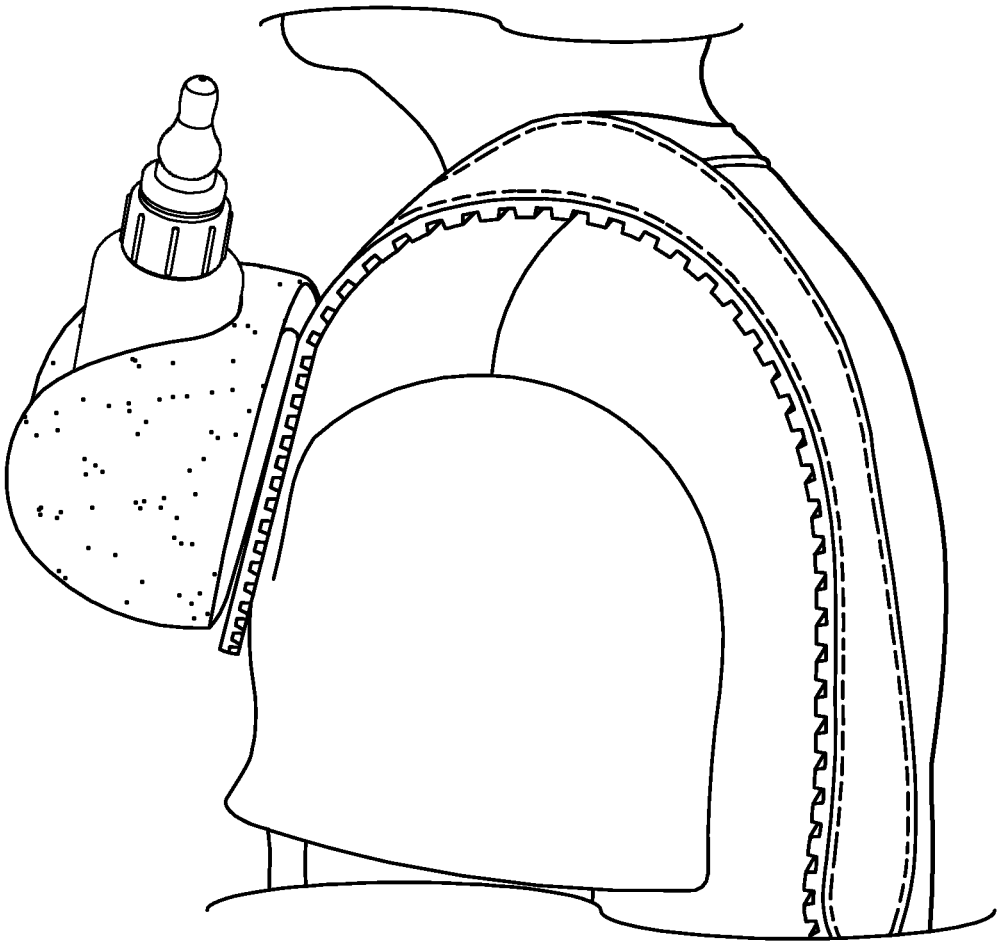
FIG. 10 is a side view of the invention on the left shoulder of a caregiver with the bottle rotated to an upward vertical position.

FIG. 10 is a side view of the invention on the left shoulder of a caregiver with the bottle rotated to an upward vertical position.

Figure 11:
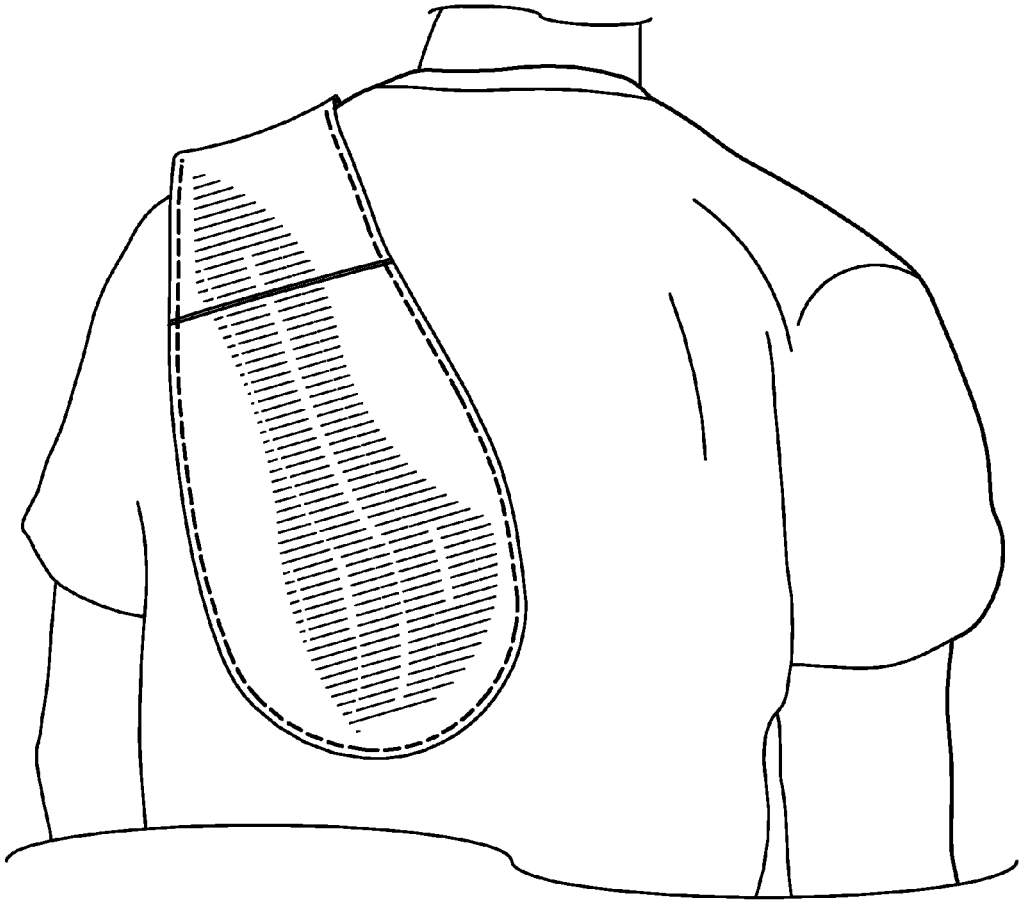
FIG. 11 shows the back of a caregiver and one half of the support pad draped over the caregiver's back.

FIG. 11 shows the back of a caregiver and one half of the support pad draped over the caregiver's back.

Figure 12:
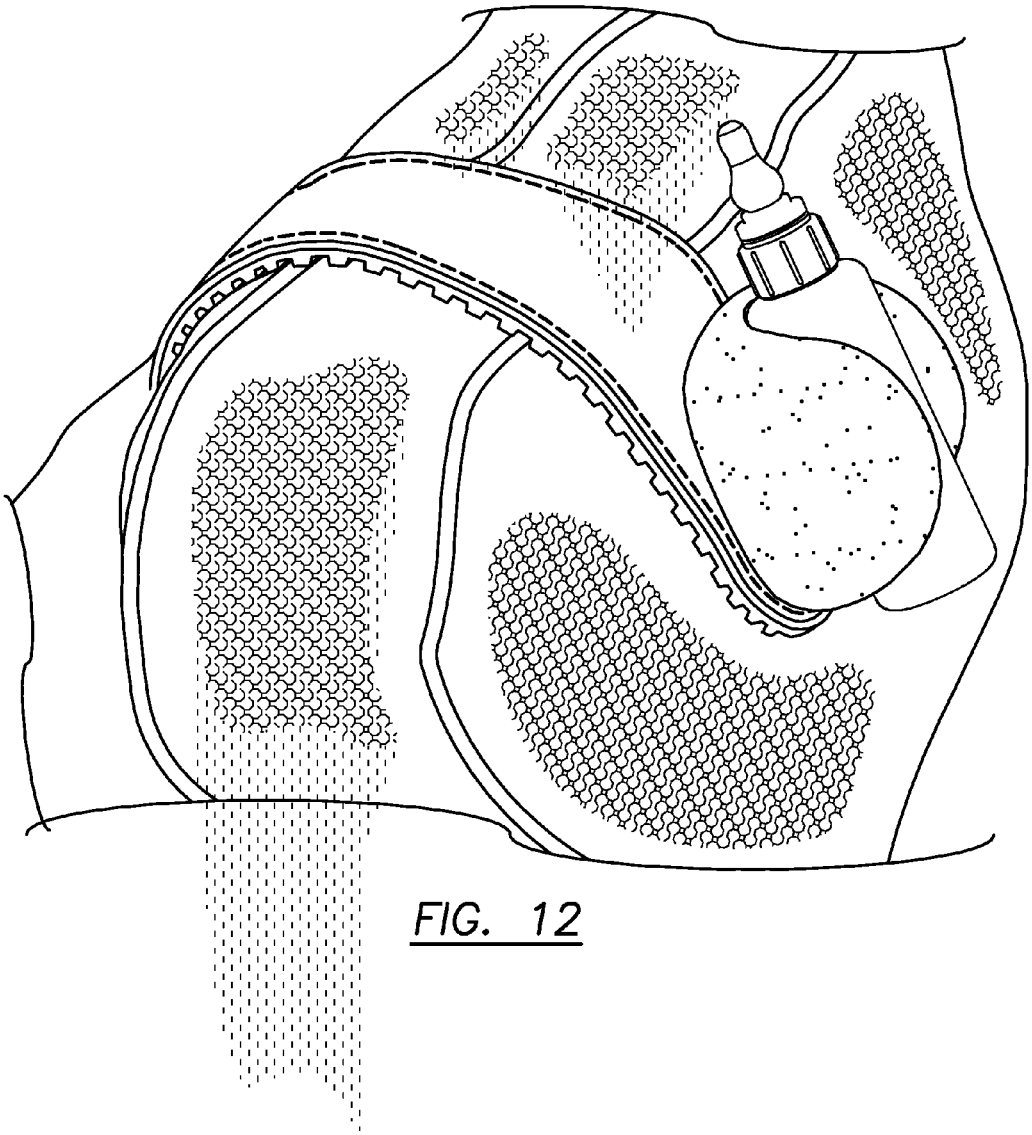
FIG. 12 shows the invention draped over the top of the chair with the baby bottle pointed upwardly.

FIG. 12 shows the invention draped over the top of the chair with the baby bottle pointed upwardly. The baby bottle can be supported in an upright position even when not being used.

Figure 13:
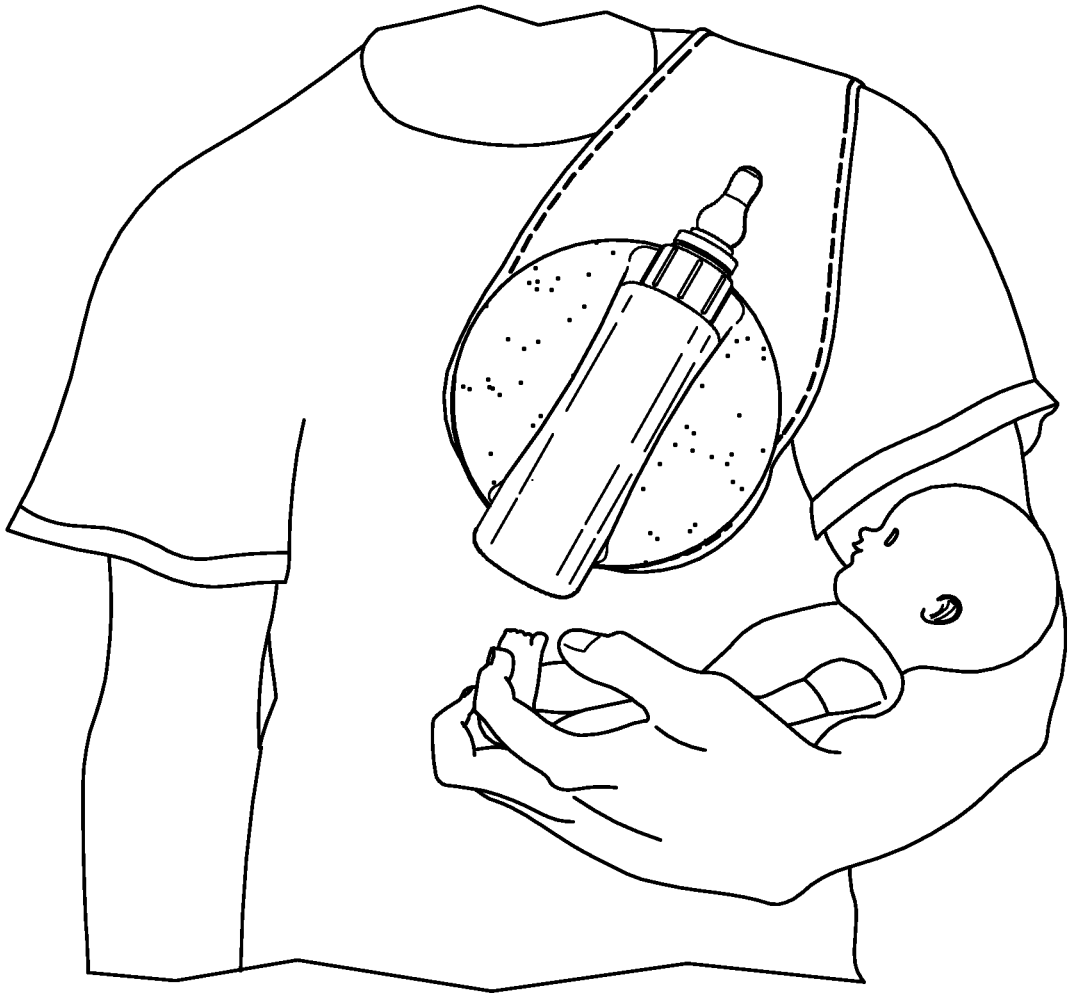
FIG. 13 shows the baby bottle pointed upwardly away from the baby and the caregiver holding the baby even though the feeding process has been interrupted.

FIG. 13 shows the baby bottle pointed upwardly away from the baby and the caregiver holding the baby even though the feeding process has been interrupted. The baby bottle holder can be rotated 360° clockwise or counterclockwise.

The instant invention has been shown and described herein in what is considered to be the most practical and preferred embodiments. It is recognized, however, that departures may be made therefrom within the scope of the invention and that obvious modifications will occur to a person skilled in the art.

What I claim is:

1. A baby bottle support system for assisting in feeding an infant from a baby bottle comprising:

a shoulder support pad of flexible material having a proximal end and distal end, and a mid-section that is narrower in width than the width of the proximal end and the distal end, said pad being configured to fit over the shoulder of a caregiver with its proximal end in front of the caregiver and its distal end behind the caregiver;

a baby bottle holder having a bottle holding portion and a holder attachment, said holder attachment being removably connected to said pad, said pad having an aperture in said proximal end, said holder attachment including a bottle holder base mounted through said pad proximal end aperture and a removable base lock connectable to said bottle holder base and said bottle holding portion comprising a resilient, smooth, circular body made entirely of a movable flexible foam having a cylindrical body cavity sized and shaped to receive and to firmly hold a baby bottle formed by said movable flexible foam cylindrical cavity to firmly secure said baby bottle in place in the cylindrical body cavity and to selectively allow insertion and removal manually of said baby bottle;

said baby bottle holder being rotatably connected to the proximal end of the pad.

2. The system of claim 1, wherein the pad is configured to fit over one shoulder of a caregiver.

3. The system of claim 2, wherein the pad is symmetrical about its longitudinal axis.

4. The system of claim 2, wherein the pad is sized such that its proximal end extends to the chest area of a caregiver.

5. The system of claim 1, wherein the entire bottom surface of the pad comprises a plurality of parallel ridges separated by valleys.

6. The system of claim 1, wherein the pad and the baby bottle holder are configured such that the location where the holder attachment connects to the proximal end of the pad provides a fixed axis about which said baby bottle holder can rotate in either direction.

7. The system of claim 6, wherein the baby bottle holder is configured to rotate 360 degrees about the fixed axis.

8. The system of claim 6, wherein the baby bottle holder additionally includes a setting mechanism defined by a toothed disc, wherein said setting mechanism allows the baby bottle holder to be manually rotated in any direction while resisting substantial non-manual movement.

* * * * *